US006250998B1

(12) United States Patent
Fladgard et al.

(10) Patent No.: US 6,250,998 B1
(45) **Date of Patent: *Jun. 26, 2001**

(54) HAND-HELD CUTTING TOOL FOR CUTTING FIBER

(75) Inventors: Lloyd Fladgard; Scott Fladgard, both of Kingston, WA (US)

(73) Assignee: Pacific International Tool & Shear, Ltd., Kingston, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,790

(22) Filed: Nov. 8, 1999

Related U.S. Application Data

(63) Continuation of application No. 09/036,249, filed on Mar. 6, 1998, now Pat. No. 5,993,303, which is a continuation of application No. 08/914,570, filed on Aug. 19, 1997, now Pat. No. 5,910,846.

(51) Int. Cl.[7] ..... A46B 13/00
(52) U.S. Cl. ..... 451/356; 30/228
(58) Field of Search ..... 30/228, 258; 125/23.01, 125/30.01, 40; 451/356

(56) References Cited

U.S. PATENT DOCUMENTS

| | | | | |
|---|---|---|---|---|
| 3,693,254 | * | 9/1972 | Salonen | 30/228 |
| 4,007,523 | * | 2/1977 | Bianco | 30/90.2 |
| 4,173,069 | * | 11/1979 | Sidenstick et al. | 30/228 |
| 4,682,416 | * | 7/1987 | Stolfa | 30/228 |
| 5,038,477 | * | 8/1991 | Parrow | 30/253 |
| 5,125,158 | * | 6/1992 | Casebolt et al. | 30/228 |
| 5,172,479 | * | 12/1992 | Keeton | 30/228 |
| 5,353,504 | * | 10/1994 | Pai | 30/228 |
| 5,365,915 | * | 11/1994 | Yu | 125/23.02 |
| 5,395,026 | * | 3/1995 | Yu | 225/96.5 |
| 5,566,454 | * | 10/1996 | Eisenbraun | 30/228 |
| 5,570,678 | * | 11/1996 | Waggoner et al. | 125/23.01 |
| 5,722,386 | * | 3/1998 | Fladgard et al. | 125/23.01 |
| 5,875,554 | * | 3/1999 | Vogelslanger | 30/228 |
| 5,993,303 | * | 11/1999 | Fladgard et al. | 451/356 |

* cited by examiner

*Primary Examiner*—Allen Ostrager
*Assistant Examiner*—William Hong
(74) *Attorney, Agent, or Firm*—Perkins Coie LLP

(57) ABSTRACT

An apparatus for cutting fiber-cement siding. A fiber-cement siding cutting tool in accordance with the invention may have a hand-held motor unit with a housing, a motor inside the housing, and a switch operatively coupled to the motor to selectively activate the motor. A head having a casing may be attached to the housing of the motor unit The head may have a reciprocating drive assembly coupled to the motor. The hand-held cutting tool also has a blade set with first and second fingers attached to either the casing or the motor housing, and a reciprocating cutting member between the first and second fingers. The first finger may have a first guide surface and a first interior surface. Similarly, the second finger may have a second straight guide surface and a second interior surface. The reciprocating cutting member has a body and a blade projecting from the body. The blade has a first side surface facing the first interior surface of the first finger, a second side surface facing the second interior surface of the second finger, and a top surface. The first side surface of the blade is preferably spaced apart from the first interior surface of the first finger by 0.040–0.055 inches for cutting ¼ inch and 5/16 inch thick fiber-cement siding. Similarly, the second side surface of the blade is spaced apart from the second interior surface of the second finger by 0.040–0.055 inches for cutting such fiber-cement siding. The distance between the first and second side surfaces and the first and second finger, respectively, may be approximately 13%–22% of the thickness of the fiber-cement siding workpiece.

24 Claims, 3 Drawing Sheets

HAND-HELD CUTTING TOOL FOR CUTTING FIBER

CROSS REFERENCE TO RELATED APPLICATIONS

This application is a continuation of Ser. No. 09/036,249 filed Mar. 6, 1998, now U.S. Pat. No. 5,993,303, which is a continuation of pending U.S. patent application 08/914,570, filed Aug. 19, 1997, now U.S. Pat. No. 5,910,846

TECHNICAL FIELD

The present invention relates to a hand-held tool for cutting fibercement siding used in the construction of buildings.

BACKGROUND OF THE INVENTION

The exteriors of houses and other types of buildings are commonly covered with siding materials that protect the internal structures from external environmental elements. The siding materials are typically planks or panels composed of wood, concrete, brick, aluminum, stucco, wood composites or fiber-cement composites. Wood siding is popular, but it is costly and flammable. Wood siding also cracks causing unsightly defects, and it is subject to infestation by insects. Aluminum is also popular, but it deforms easily, expands and contracts in extreme climates and is relatively expensive. Brick and stucco are also popular in certain regions of the country, but they are costly and laborintensive to install.

Fiber-cements siding (FCS) offers several advantages compared to other types of siding materials. FCS is made from a mixture of cement, silica sand, cellulose and a binder. To form FCS siding products, a liquid fiber-cement mixture is pressed and then cured to form FCS planks, panels and boards. FCS is advantageous because it is non-flammable, weather-proof, and relatively inexpensive to manufacture. Moreover, FCS does not rot or become infested by insects. FCS is also advantageous because it may be formed with simulated wood grains or other ornamental designs to enhance the appearance of a building. To install FCS, a siding contractor cuts the panels or planks to a desired length at a particular job site. The siding contractor then abuts one edge of an FCS piece next to another and nails the cut FCS pieces to the structure. After the FCS is installed, trim materials may be attached to the structure and the FCS may be painted.

Although FCS offers many advantages over other siding materials, it is difficult and expensive to cut. Siding contractors often cut FCS with a circular saw having an abrasive disk. Cutting FCS with an abrasive disk, however, generates large amounts of very fine dust that creates a very unpleasant working environment Siding contractors also cut FCS with shears having opposing blades, as set forth in U.S. Pat. No. 5,570,678 and U.S. Pat. No. 5,722,386 which are herein incorporated by reference. Although the shears set forth in these patents cut a clean edge in FCS without producing dust, many siding contractors prefer to use a hand-held tool because they are accustomed to cutting siding with hand saws. Therefore, in light of the positive characteristics of FCS and the need for a hand-held cutting tool, it would be desirable to develop a hand-held cutting tool that quickly cuts clean edges through FCS without producing dust.

To meet the demand for a hand-held FCS cutting tool, the present inventors developed a hand-held tool with a reciprocating cutting blade (the "original hand held-tool"). The original hand-held tool had a motor-unit, a drive assembly coupled to the motor-unit to generate a reciprocating motion, and a blade set with a moving blade between first and second stationary fingers. The motor-unit was a 1046–90 Black and Decker ® electric drill motor, and the drive assembly was a shear head manufactured by Kett Tool Co. of Cincinnati, Ohio. The moving blade was coupled to the Kett shear head to reciprocate between the first and second fingers. Additionally, the first and second fingers were spaced apart by 0.250 inches, and the cutting blade had a thickness of 0.185–0.200 inches. The sides of the cutting blade were accordingly spaced apart from the fingers by 0.025–0.0325 inches.

In the operation of the original hand-held tool, the fingers were placed on an FCS workpiece and the moving blade was driven. from an open position below the workpiece to a closed position in the gap between the first and second fingers. As the blade moved from the open position to the closed position, it sheared the workpiece along both sides of the blade to form a cut in the workpiece approximately as wide as the gap between the first and second fingers. An operator would accordingly push the tool as the blade reciprocated between the open and closed positions to cut the workpiece.

One drawback of the original hand-held tool, however, was that the drive assembly and the motor-unit were subject to premature failure. One possible solution for reducing premature failure of the hand-held tool was to use stronger materials in the drive mechanism. Yet, using stronger materials would require more expensive metals that would increase the cost of the tools. Another possible solution for the original hand-held tool was to increase the size of the components of the motor unit and the drive mechanism. Using larger components, however, would increase the weight of the tools making them more difficult to handle. In addition to these constraints, cutting FCS without dust presents many challenges that are not present in other materials because FCS is a relatively brittle material that tends to crack along rough edges and unpredictable paths. As such, FCS cannot be cut with a thin blade unless it is in an opposing shear like those disclosed in U.S. Pat. Nos. 5,722,386 and 5,570,678. Thus, it would be desirable to develop a hand-held cutting tool that cuts a clean edge in FCS and is not subject to premature failure.

SUMMARY OF THE INVENTION

The present invention is an apparatus for cutting fibercement siding. A fiber-cement siding cutting tool in accordance with the invention may have a hand-held motor unit with a housing, a motor inside the housing, and a switch operatively coupled to the motor to selectively activate the motor. A head having a casing may be attached to the housing of the motor unit. The head may also have a reciprocating drive assembly coupled to the motor.

The hand-held cutting tool also has a blade set with first and second fingers attached to either the casing or the motor housing, and a reciprocating cutting member between the first and second fingers. The first finger may have a first guide surface and a first interior surface. Similarly, the second finger may have a second guide surface and a second interior surface. The first and second guide surfaces are preferably in a common plane, and the first and second interior surfaces are spaced apart from one another by a gap distance. The reciprocating cutting member of the blade set has a body with a first width approximately equal to the gap distance and a blade projecting from the body. The blade has a first side surface facing the first interior surface of the first finger, a second side surface facing the second interior surface of the second finger, and a top surface. The first side surface of the blade is preferably spaced apart from the first interior surface of the first finger by 0.040–0.055 inches for cutting ¼ inch and 5/16 inch thick fiber-cement siding. Similarly, the second side surface of the blade is spaced apart from the second interior surface of the second finger by 0.040–0.055 inches. The distance between the first and second side surfaces of the blade and the first and second fingers, respectively, may be approximately 13%–22% of the thickness of the fiber-cement siding workpiece.

The top surface of the blade may also have a width less than the first width of the body. For example, the top surface of the blade may be between 0.140 and 0.165 inches, and more preferably between 0.160 and 0.160 for cutting ¼ inch and 5/16 inch thick fiber-cement siding. The top surface may also have a curvature concave with respect to the first and second guide surfaces of the first and second fingers.

In operation, the drive assembly is operatively coupled to the reciprocating member to reciprocate the blade into and out of the gap between the fingers. As the drive assembly moves the blade into the gap between the fingers, the top surface of the blade and the straight guide surfaces of the fingers shear the fiber-cement siding.

DETAILED DESCRIPTION OF THE INVENTION

The present invention is an apparatus for cutting fiber-cement siding. Many specific details of certain embodiments of the invention are set forth in the following description and in FIGS. 1–3 to provide a thorough understanding of such embodiments. One skilled in the art, however, will understand that the present invention may have additional embodiments, or that the invention may be practiced without several of the details described in the following description.

Figure 1:
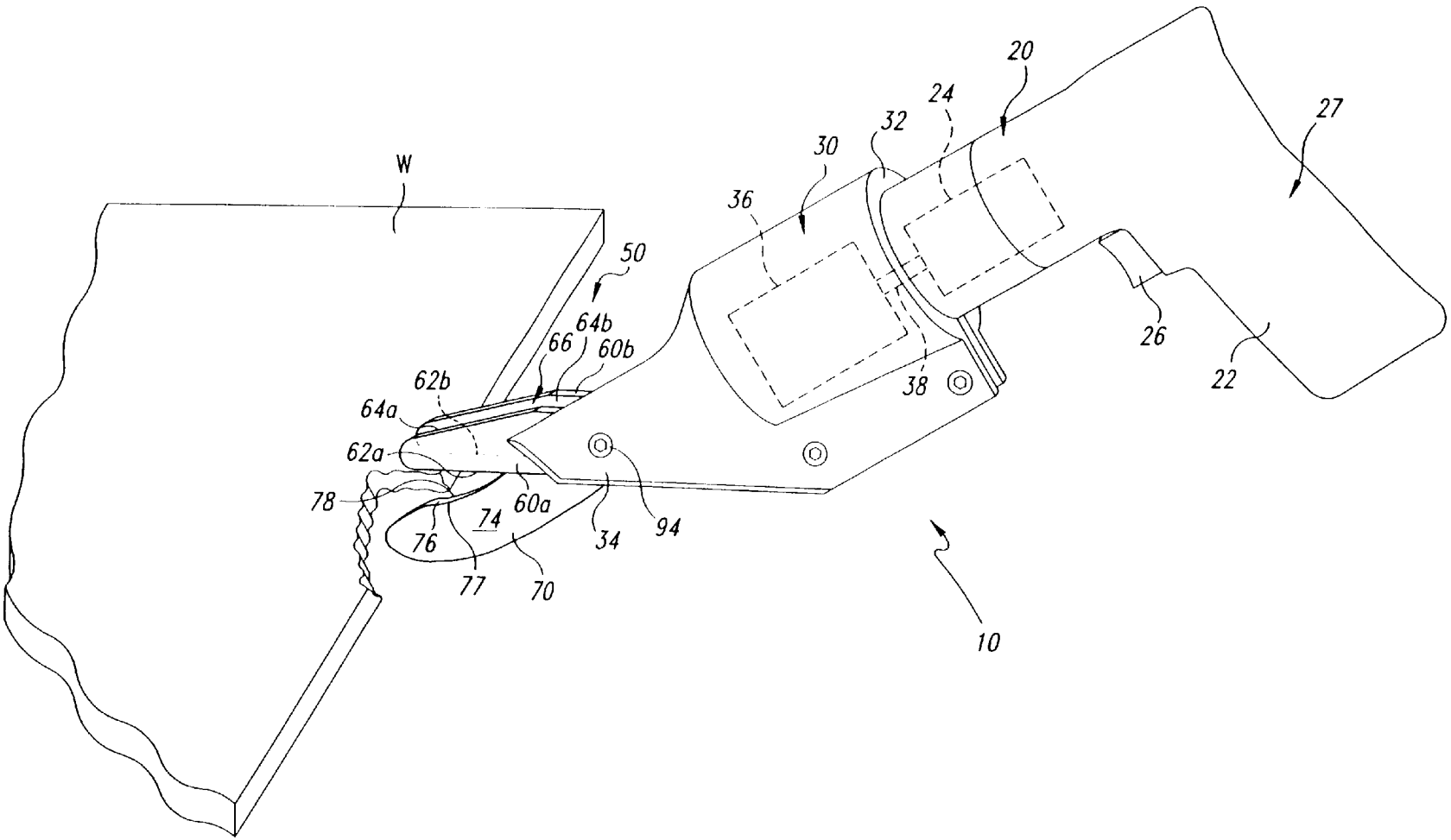
FIG. 1 is an isometric view of a fiber-cement cutting tool and a blade set in accordance with one embodiment of the invention.

FIG. 1 is an isometric view of a hand-held cutting tool 10 for cutting an FCS workpiece W. The cutting tool 10 has a motor unit 20 with a housing 22, a motor 24 (shown schematically in phantom) inside the housing 22, and a switch 26 operatively coupled to the motor 24. The housing 22 preferably has a handle 27 configured to be gripped by an operator. One suitable motor unit 20 is the No. 3208–90 electric motor unit manufactured by Black and Decker Corporation. Another suitable motor unit 20 is the No. 7802 pneumatic motor unit manufactured by Ingersoll-Rand Corporation.

The output of the motor unit 20 may be converted into a reciprocal motion with a head 30 having a casing 32 and a reciprocating drive assembly 36 (shown schematically in phantom). The casing 32 is attached to the housing 22 of the motor unit 20. Additionally, the reciprocating drive assembly 36 is coupled to the motor 24 via a gear assembly 38 (shown schematically in phantom) to translate the rotational output from the motor unit 20 into a reciprocating motion. A suitable head 30 is the shear head manufactured by Kett Tool Co., as set forth by U.S. Pat. No. 4,173,069, entitled "Power Shear Head," which is herein incorporated by reference.

The cutting tool 10 may also have a blade set 50 with a first finger 60*a* attached to one side of the head 30, a second finger 60*b* attached to another side of the head 30, and a cutting member 70 between the first and second fingers 60*a* and 60*b*. The first finger 60*a* has a guide surface 62*a* and a first interior surface 64*a*. Similarly, the second finger 60*b* has a second guide surface 62*b* (shown in phantom) and a second interior surface 64*b*. The first and second fingers 60*a* and 60*b* are preferably attached to the head 30 to space the first and second interior surfaces 64*a* and 64*b* apart from one another by a gap 66 in which the cutting member 70 may be received. Additionally, the first and second guide surfaces 62*a* and 62*b* are preferably straight to rest flat on top of the FCS workpiece W for aligning the cutting member 70 with the workpiece W.

Figure 2:
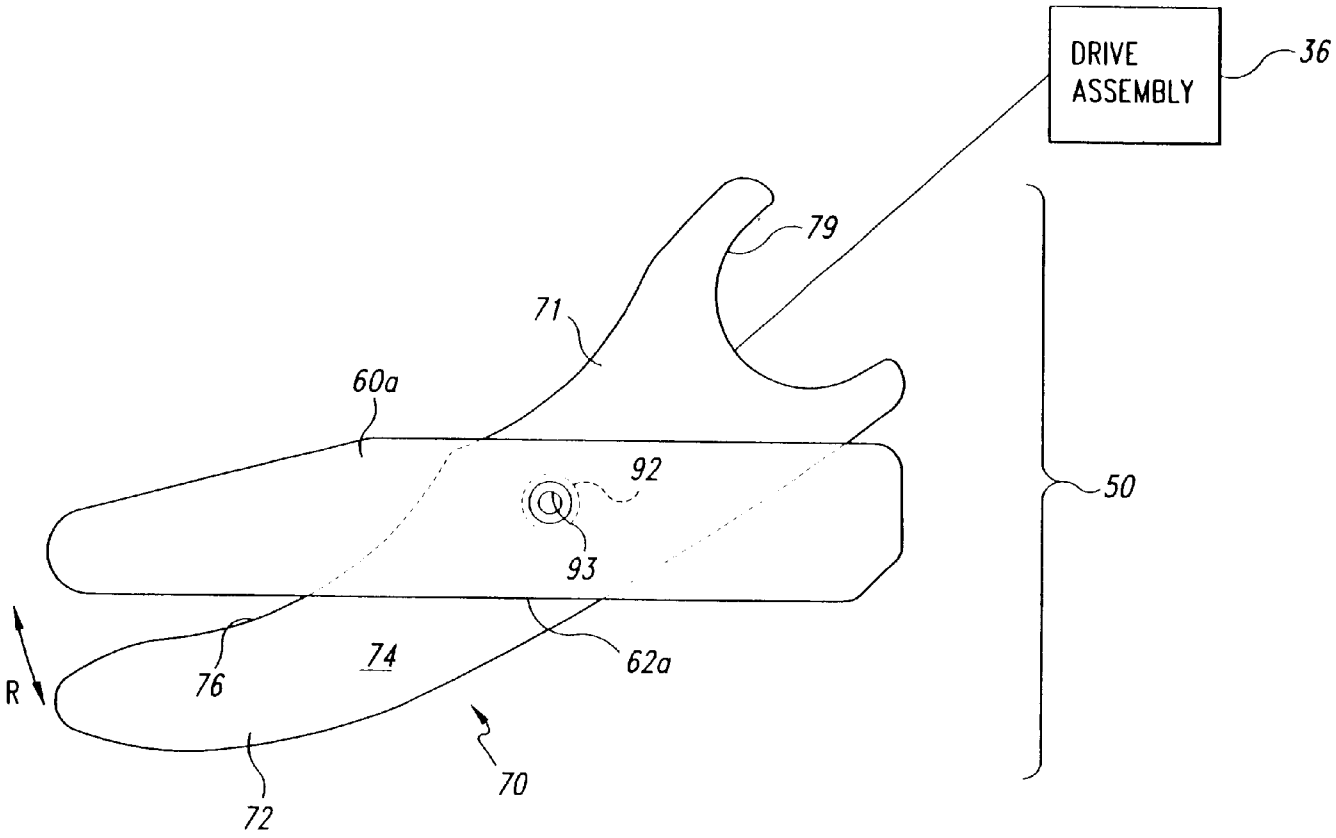
FIG. 2 is a side elevational view of the blade set of FIG. 1.
Figure 3:
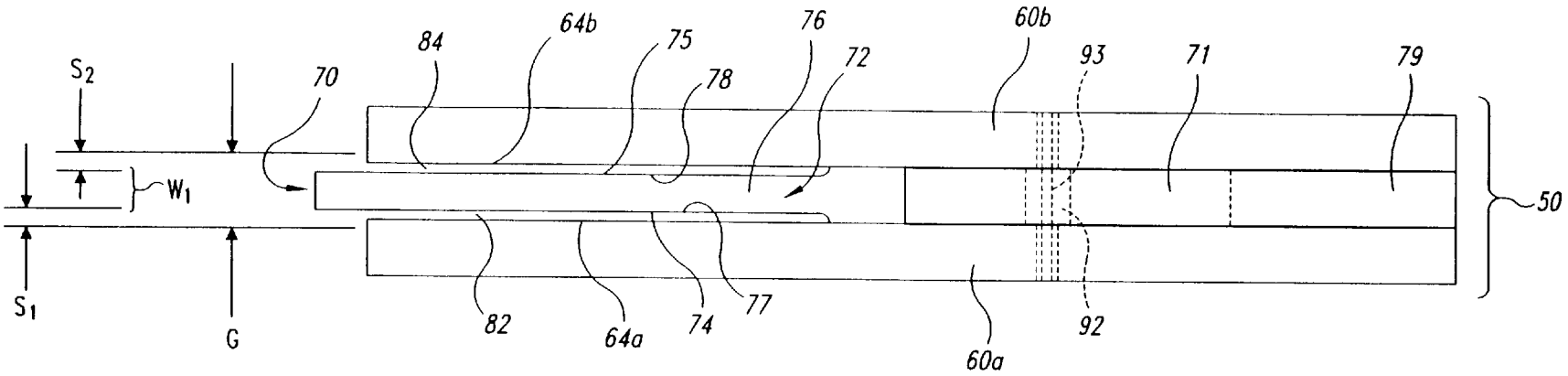
FIG. 3 is a top plan view of the blade set of FIG. 1.

FIG. 2 is a side elevational view and FIG. 3 is a top plan view of the blade set 50 used with the FCS cutting tool 10. The cutting member 70 may have a body 71 with a first width approximately equal to a gap distance G between the first interior surface 64*a* of the first finger 60*a* and the second interior surface 64*b* of the second finger 60*b*. The cutting member 70 may also have blade 72 projecting from the body 71 between the first and second fingers 60*a* and 60*b*. The blade 72 has a first side surface 74 facing the first interior surface 64*a*, a second side surface 75 facing the second interior surface 64*b*, and a curved top surface 76. The edge along the top surface 76 and the first side surface 74 defines a first cutting edge 77 (best shown in FIG. 1), and the edge along the top surface 76 and the second side surface 75 defines a second cutting edge 78 (best shown in FIG. 1).

In a particular embodiment, the first side surface 74 is spaced apart from the first interior surface 64*a* by a distance $S_1$ to define a first side space 82. Similarly, the second side surface 75 is spaced apart from the second interior surface 64*b* by a distance $S_2$ to define a second side space 8. The spacing between the sides 74 and 75 of the blade 72 and the interior surfaces 64*a* and 64*b* of the fingers 60*a*, 60*b* may be a function of the overall gap width G between the fingers 60*a* and 60*b*. Additionally, the spacing between the sides of the blade and the fingers may be a function of the thickness of the FCS workpiece W. For example, when the FCS workpiece W has a thickness of between 0.25 and 0.3125 inches, the distances $S_1$ and $S_2$ are between 0.040–0.055 inches and the gap width G is 0.25 inches. More preferably, the distances $S_1$ and $S_2$ are between 0.0425–0.045 inches. The distances $S_1$ and $S_2$ of each of the spaces 82 and 84, therefore, may be approximately 16% to 22% of the gap width G between the fingers 60*a* and 60*b*, and preferably between 17% and 18% of the gap width G.

The spacing between the sides of the blade 72 and the fingers 60*a* and 60*b* may be selected by adjusting the thickness of the top surface 76 of the blade 72. For a gap width G of 0.25 inches between the fingers 60*a* and 60*b*, the top surface 76 of the blade 72 may be 0.140–0.170 inches wide, and is preferably between 0.160 and 0.165 inches wide. Additionally, the top surface 76 may have a curvature that is concave with respect to the guide surfaces 62*a* and 62*b* of the fingers 60*a* and 60*b*. As best shown in FIG. 1, therefore, the first and second cutting edges 77 and 78 are also concave with respect to the FCS workpiece W. The curvature of the top surface 76 may be a radius between 1.500 and 2.00 inches, and is preferably approximately 1.75 inches.

The reciprocating cutting member 70 is pivotally coupled to the first and second fingers 60*a* and 60*b* by a bushing 92 (FIGS. 2 and 3). Additionally, the bushing 92 has an opening 93 (FIG. 2) to receive a bolt 94 (FIG. 1) that passes through the head 30 (FIG. 1). The reciprocating cutting member 70 also has a driven end 79 configured to engage the reciprocating drive assembly 36 of the head 30.

In operation, the motor 24 moves the drive assembly 36 when an operator depresses the switch 26. The drive assembly 36 reciprocates the blade 72 of the cutting member 70 along a reciprocating path R (FIG. 2) between an open position (FIGS. 1 and 2) and a closed position (not shown) in which the top surface 76 of the blade 72 is above the guide surfaces 62*a* and 62*b* of the fingers 60*a* and 60*b*. In one embodiment, the blade 72 reciprocates at approximately 0–3,000 strokes per minute. As the blade 72 moves from the open position to the closed position, the first cutting edge 77 and the first interior surface 64*a* shear the FCS workpiece W along one line, and the second cutting edge 78 and the second interior surface 64*b* shear the FCS workpiece along a parallel line. The top surface 76 accordingly lifts and separates a cut section (not shown) of the FCS workpiece W with each upward stroke of the blade 72. To cut a continuous line through the workpiece W, an operator pushes the cutting tool 10 across the workpiece W as the blade 72 reciprocates.

The motor 24 and the drive assembly 36 of the cutting tool 10 have significantly lower failure rates than the original hand-held tool developed by the present inventors. One aspect of the invention is that the inventors discovered that the binder and the cellulose in FCS causes significant friction between the FCS and the cutting blade at the very high velocities of the cutting blade 72. The inventors believe that the heat generated from the blade 72 melts the binder and/or the cellulose, and that the melted matter increases the friction between the blade 72 and the FCS workpiece W. From this discovery, the inventors further discovered that increasing the size of the spaces 82 and 84 between the blade 72 and the fingers 60*a* and 60*b* significantly reduced premature failure of the motor 24 and the drive assembly 36. The inventors believe that increasing the spaces 82 and 84 reduces the friction between the cutting blade 72 and the workpiece 10. More specifically, for a ¼ inch or 5/16 inch thick FCS workpiece, the side distances $S_1$ and $S_2$ between the blade 72 and the first and second fingers 60*a* and 60*b* are between 0.040 and 0.055 inches instead of being 0.025–0.0325 inches in the original hand-held tool developed by the present inventors. The blade set 50 accordingly increases the side distances $S_1$ and $S_2$ by approximately 23%–120%. Thus, by increasing the spaces 82 and 84, blade set 50 enhances the operational life of the motor 24 and the drive assembly 36.

The cutting tool 10 with the blade set 50 also produces a clean, straight edge along the cut Because FCS tends to rip or crack along unpredictable lines when it is cut with a thin blade, the art generally taught that it is better to minimize the space between the blade 72 and the fingers 60*a* and 60*b* to create a more defined shear region in an FCS workpiece. Nonetheless, in contrast to the art, the blade set 50 increases the distances $S_1$ and $S_2$ between the blade 72 and the first and second fingers 60*a* and 60*b* without sacrificing the quality of the cut. Thus, the blade set 50 of the cutting tool 10 not only provides a cost effective solution for reducing the premature failure of the motor 24 and the drive assembly 36, but it also produces a clean edge along the cut.

The particular dimensions for the blade set 50 described above with reference to FIGS. 1–3 are particularly useful for cutting ¼ inch and 5/16 inch thick FCS workpieces. It is expected that the side distances $S_1$ and $S_2$ between the blade 72 and the first and second fingers 60*a* and 60*b* may be varied according to the thickness of the particular FCS workpiece. Accordingly, the side distances $S_1$ and $S_2$ are preferably between 13% and 22% of the thickness of the FCS workpiece being cut. Additionally, the top surface 76 of the blade 72 is preferably between 44% and 68% of the thickness of the particular FCS workpiece. Therefore, the particular dimensions of the blade set 50 for cutting FCS siding may be adjusted relative to the FCS workpiece W.

From the foregoing it will be appreciated that, although specific embodiments of the invention have been described herein for purposes of illustration, various modifications may be made without deviating from the spirit and scope of the invention. For example, the first and second fingers may be attached to the motor unit instead of the head. Accordingly, the invention is not limited except as by the appended claims.

What is claimed is:

1. A method of cutting a fiber-cement workpiece, comprising:

pressing a first guide surface of a first guide member and a second guide surface of a second guide member against a surface of the workpiece, the first guide member having a first interior surface and the second guide member having a second interior surface spaced apart from the first interior surface by a gap;

reciprocating a cutting blade between the first and second guide members and along a path transverse to the surface of the workpiece, the cutting blade having a first side spaced apart from the first interior surface by a first side spacing and the cutting blade having a second side spaced apart from the second interior surface by a second side spacing, wherein the first side spacing and the second side spacing are approximately 0.040 to 0055 inch; and moving the cutting blade along a cutting path through the fiber-cement workpiece.

2. A method of cutting a fiber-cement workpiece, comprising:

pressing a first guide surface of a first guide member and a second guide surface of a second guide member against a surface of the workpiece, the first guide member having a first interior surface and the second guide member having a second interior surface spaced apart from the first interior surface by a gap;

reciprocating a cutting blade between the first and second guide members and along a path transverse to the surface of the workpiece, the cutting blade having a first side spaced apart from the first interior surface by a first side spacing and the cutting blade having a second side spaced apart from the second interior surface by a second side spacing, wherein the first side spacing and the second side spacing are approximately 13% to 22% of a thickness of the fiber-cement workpiece; and moving the cutting blade along a cutting path through the fiber-cement workpiece.

3. A method of cutting a fiber-cement workpiece, comprising:

pressing a first guide surface of a first guide member and a second guide surface of a second guide member against a surface of the workpiece, the first guide member having a first interior surface and the second guide member having a second interior surface spaced apart from the first interior surface by a gap distance;

reciprocating a cutting blade between the first and second guide members and along a path transverse to the surface of the workpiece, the cutting blade having a first side spaced apart from the first interior surface by a first side spacing and the cutting blade having a second side spaced apart from the second interior face by a second side spacing, wherein the first side spacing and the second side spacing are approximately 16% to 22% of is the gap distance; and moving the cutting blade along a cutting path through the fiber-cement workpiece.

4. A method of cutting fiber-cement siding, comprising:

pressing first and second fingers of a cutting tool against a first side of a fiber-cement siding workpiece, the fiber-cement siding workpiece having a first thickness;

driving a cutting blade of the cutting tool from a second side of the fibercement siding workpiece toward the first side of the fiber-cement siding workpiece and into a gap between the first and second fingers; and spacing a first side of the cutting blade apart from the first finger by a distance first distance and spacing a second side of the cutting blade apart from the second finger by a second distance, the first and second distances being between 13% and 22% of the first thickness of the fiber-cement siding workpiece.

5. The method of claim 4 wherein the workpiece has a thickness of between 0.25 and 0.3125 inches and the first and second distances are between 0.040 and 0.055 inches.

6. The method of claim 4 wherein the workpiece has a thickness of between 0.25 and 0.3125 inches and the first and second distances are between 0.0425 and 0.045 inches.

7. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces define a guide plane, and wherein the first interior surface is juxtaposed to the second interior surface across a gap; and a cutting blade between the first and second guide members and coupled to the drive assembly to reciprocate between the first and second guide members along a path transverse to the guide plane, the cutting blade having a first side spaced apart from the first interior surface of the first guide member by a first side spacing and the cutting blade having a second side spaced apart from the second interior surface of the second guide member by a second side spacing, wherein the first side spacing and the second side spacing are from 0.040 to 0.055 inch to inhibit premature wear of the motor or the drive assembly and to provide even edge cuts along a fiber-cement workpiece cut by the cutting blade.

8. The cutting tool of claim 7 wherein the blade has a width of 0.25 inch.

9. The cutting tool of claim 7 wherein the first side spacing and the second side spacing are approximately 0.0425 to 0045 inch.

10. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to, the drive unit, the first guide member having a first guide surface and a first interior surface, and the second guide member having a second guide surface and a second interior surface, wherein the first and second guide surfaces define a guide plane, and wherein the first interior surface is juxtaposed to the second interior surface across a gap; and a cutting blade between the first and second guide members and coupled to the drive assembly to reciprocate between the first and second guide members along a path transverse to the guide plane, the cutting blade having a first side spaced apart from the first interior surface of the first guide member by a first side spacing and the cutting blade having a second side spaced apart from the second interior surface of the second guide member by a second side spacing, wherein the first side spacing and the second side spacing are from 13% to 22% of a thickness of a fiber-cement workpiece to be cut with the blade to inhibit premature wear of the motor or the drive assembly and to provide even edge cuts along the fiber-cement workpiece.

11. The cutting tool of claim 10 wherein the blade has a width of 0.25 inch.

12. The cutting tool of claim 10 wherein the first side spacing and the second side spacing are approximately 0.040 to 0.055 inch.

13. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces define a guide plane, and wherein the first interior surface is spaced apart from the second interior surface by a gap distance; and a cutting blade between the first and second guide members and coupled to the drive assembly to reciprocate between the first and second guide members along a path transverse to the guide plane, the cutting blade having a first side spaced apart from the first interior surface of the fist guide member by a first side spacing and the cutting blade having a second side spaced apart from the second interior surface of the second guide member by a second side spacing, wherein the first side spacing and the second side spacing are from 16% to 22% of the gap distance to inhibit premature wear of the motor or the drive assembly and to provide even edge cuts along a fiber-cement workpiece cut by the cutting blade.

14. The cutting tool of claim 13 wherein the blade has a width of 0.25 inch.

15. The cutting tool of claim 13 wherein the first side spacing and the second side spacing are approximately 0.0425 to 0.045 inch.

16. A fiber-cement cutting tool comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces define a guide plane, and wherein the first interior surface is juxtaposed to the second interior surface across a gap; and a cutting blade between the first and second guide members and coupled to the drive assembly to reciprocate between the first and second guide members along a path transverse to the guide plane, the cutting blade having a first side spaced apart from the first interior surface of the fast guide member by a first side spacing, a second side spaced apart from the second interior surface of the second guide member by a second side spacing, and a top surface between the first and second sides having a curvature concave with respect to the first and second guide surfaces, wherein the first side spacing and the second side spacing are from 0.040 to 0.055 inch to inhibit premature wear of the motor or the drive assembly and to provide even edge cuts along a fiber-cement workpiece cut by the cutting blade.

17. The cutting tool of claim 16 wherein the blade has a width of 0.25 inch.

18. The cutting tool of claim 16 wherein the first side spacing and the second side spacing are approximately 0.0425 to 0.045 inch.

19. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces define a guide plane, and wherein the first interior surface is juxtaposed to the second interior surface across a gap; and a cutting blade between the first and second guide members and coupled to the drive assembly to reciprocate between the first and second guide members along a path transverse to the guide plane, the cutting blade having a first side spaced apart from the first interior surface of the first guide member by a first side spacing, a second side spaced apart from the second interior surface of the second guide member by a second side spacing, and a top surface between the first and second sides having a curvature concave with respect to the first and second guide surfaces, wherein the first side spacing and the second side spacing are from 13% to 22% of a thickness of a fiber cement workpiece to be cut with the blade to inhibit premature wear of the motor or the drive assembly and to provide even edge cuts along the fiber-cement workpiece.

20. The cutting tool of claim 19 wherein the blade has a width of 0.25 inch.

21. The cutting tool of claim 19 wherein the first side spacing and the second side spacing are approximately 0.040 to 0.055 inch.

22. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces define a guide plane, and wherein the first interior surface is spaced apart from the second interior surface by a gap distance; and a cutting blade between the first and second guide members and coupled to the drive assembly to reciprocate between the first and second guide members along a path transverse to the guide plane, the cutting blade having a first side spaced apart from the first interior surface of the first guide member by a first side spacing, a second side spaced apart from the second interior surface of the second guide member by a second side spacing, and a top surface between the first and second sides having a curvature concave with respect to the first and second guide surfaces, wherein the first side spacing and the second side spacing are from 16% to 22% of the gap distance to inhibit premature wear of the motor or the drive assembly and to provide even edge cuts along a fiber-cement workpiece cut by the cutting blade.

23. The cutting tool of claim 22 wherein the blade has a width of 0.25 inch.

24. The cutting tool of claim 22 wherein the first side spacing and the second side spacing are approximately 0.0425 to 0.045 inch.

* * * * *

UNITED STATES PATENT AND TRADEMARK OFFICE

CERTIFICATE OF CORRECTION

PATENT NO. : 6,250,998 B1
DATED : June 26, 2001
INVENTOR(S) : Fladgard et al.

It is certified that error appears in the above-identified patent and that said Letters Patent is hereby corrected as shown below:

Title page,
Delete all continuing data in item (63), and subsitute therefor the following:
-- Continuation of application No. 09/036,249, Mar. 6, 1998, Pat. No. 5,993,303 --, therefor.

Column 1,
Lines 6-10, delete the entire paragraph.
Lines 6-10, please add the folowing:
-- This application is a continuation of United States Patent Application No. 09/036, 249, filed on March 6, 1998, now issued as U.S. Patent No. 5,993,303. --

Signed and Sealed this

Eighteenth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,250,998 B1 
DATED : June 26, 2001
INVENTOR(S) : Lloyd Fladgard et al.

It is certified that error appears in the above-identified patent and that said Letters Patent is hereby corrected as shown below:

Title page, Item [54] and Column 1, lines 1-2,
Title "HAND-HELD CUTTING TOOL FOR CUTTING FIBER" should be
-- HAND-HELD CUTTING TOOL FOR CUTTING FIBER-CEMENT SIDING --

Item [63], Related U.S. Application Data, should only be "Continuation of application No. 09/036,249, filed on Mar. 6, 1998, now Pat. No. 5,993,303."

Item [57], ABSTRACT,
Line 6, "unit The" should be "unit. The"

Column 1,
Lines 7-10, should only be "This application is a continuation of Ser. No. 09/036, 249, filed on Mar. 6, 1998, now U.S. Pat No. 5,993, 303."
Line 14, "fibercement" should be -- fiber-cement --
Line 31, "laborintensive" should be -- labor-intensive --
Line 32, "Fiber-cements" should be -- Fiber-cement --
Line 54, "environment" should be -- environment. --

Column 2,
Line 16, "driven." should be -- driven --.

Column 3,
Line 16, "0.160 and 0.160" should be -- 0.160 and 0.165 --

Column 5,
Line 49, "cut Because" should be -- cut. Because --

Column 6,
Line 33, "0055" should be -- 0.055 --

Column 7,
Line 2, "face" should be -- surface --
Line 5, "of is" should be -- of --
Line 13, "fibercement" should be -- fiber-cement --
Line 17, "by a distance first" should be -- by a first --
Line 59, "0045" should be -- 0.045 --
Line 66, "to, the drive" should be -- to the drive --

Column 8,
Line 58, "tool comprising:" should be -- tool, comprising: --

UNITED STATES PATENT AND TRADEMARK OFFICE

CERTIFICATE OF CORRECTION

PATENT NO. : 6,250,998 B1
DATED : June 26, 2001
INVENTOR(S) : Lloyd Fladgard et al.

It is certified that error appears in the above-identified patent and that said Letters Patent is hereby corrected as shown below:

Column 9,
Line 9, "fast" should be -- first --

Column 10,
Line 3, "fiber cement" should be -- fiber-cement --

Signed and Sealed this

Seventeenth Day of September, 2002

*Attest:*

*Attesting Officer*

JAMES E. ROGAN
*Director of the United States Patent and Trademark Office*

US006250998C1

(12) EX PARTE REEXAMINATION CERTIFICATE (7218th)

United States Patent

Fladgard et al.

(10) Number: US 6,250,998 C1

(45) Certificate Issued: *Dec. 8, 2009

(54) HAND-HELD CUTTING TOOL FOR CUTTING FIBER-CEMENT SIDING

(75) Inventors: Lloyd Fladgard, Kingston, WA (US); Scott Fladgard, Kingston, WA (US)

(73) Assignee: Pactool International, Ltd., Kingston, WA (US)

Reexamination Request:
No. 90/008,967, Apr. 21, 2008

Reexamination Certificate for:

| | |
|---|---|
| Patent No.: | **6,250,998** |
| Issued: | **Jun. 26, 2001** |
| Appl. No.: | **09/436,790** |
| Filed: | **Nov. 8, 1999** |

( * ) Notice: This patent is subject to a terminal disclaimer.

Certificate of Correction issued Sep. 18, 2001.

Certificate of Correction issued Sep. 17, 2002.

Related U.S. Application Data

(63) Continuation of application No. 09/036,249, filed on Mar. 6, 1998, now Pat. No. 5,993,303.

(51) Int. Cl.
*A46B 13/00* (2006.01)

(52) U.S. Cl. ..... 451/356; 30/228; 257/E21.528

(58) Field of Classification Search ..... 30/228
See application file for complete search history.

(56) References Cited

U.S. PATENT DOCUMENTS

| | | | | | |
|---|---|---|---|---|---|
| 2,760,265 | A | * | 8/1956 | Draenert | 30/247 |
| 4,173,069 | A | * | 11/1979 | Sidenstick et al. | 30/228 |
| 4,617,219 | A | * | 10/1986 | Schupack | 428/113 |
| 5,225,237 | A | * | 7/1993 | Magnani | 442/57 |
| 5,901,447 | A | * | 5/1999 | Dunning | 30/228 |

FOREIGN PATENT DOCUMENTS

| | | |
|---|---|---|
| JP | 5228793 | * 2/1977 |
| JP | 52129087 | * 10/1977 |

OTHER PUBLICATIONS

Pacific International Tool & Shear, Ltd.; Product Catalog; Snapper series (SS301, SS302, and SS303); date unknown; 2 pages.

* cited by examiner

*Primary Examiner*—Cary E. O'Connor

(57) ABSTRACT

An apparatus for cutting fiber-cement siding. A fiber-cement siding cutting tool in accordance with the invention may have a hand-held motor unit with a housing, a motor inside the housing, and a switch operatively coupled to the motor to selectively activate the motor. A head having a casing may be attached to the housing of the motor unit. The head may have a reciprocating drive assembly coupled to the motor. The hand-held cutting tool also has a blade set with first and second fingers attached to either the casing or the motor housing, and a reciprocating cutting member between the first and second fingers. The first finger may have a first guide surface and a first interior surface. Similarly, the second finger may have a second straight guide surface and a second interior surface. The reciprocating cutting member has a body and a blade projecting from the body. The blade has a first side surface facing the first interior surface of the first finger, a second side surface facing the second interior surface of the second finger, and a top surface. The first side surface of the blade is preferably spaced apart from the first interior surface of the first finger by 0.040-0.055 inches for cutting ¼ inch and 5/16 inch thick fiber-cement siding. Similarly, the second side surface of the blade is spaced apart from the second interior surface of the second finger by 0.040–0.055 inches for cutting such fiber-cement siding. The distance between the first and second side surfaces and the first and second finger, respectively, may be approximately 13%–22% of the thickness of the fiber-cement siding workpiece.

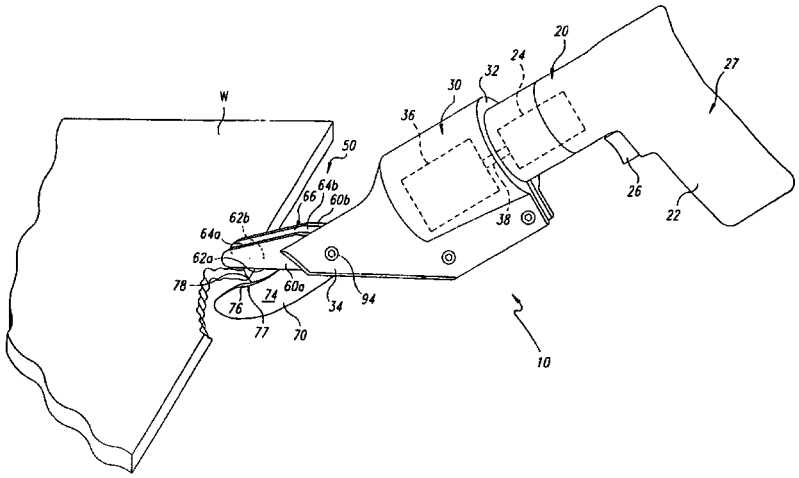

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4–6 and 9 are cancelled.

Claims 1, 2 and 7 are determined to be patentable as amended.

Claims 3, 8 and 10–24 were not reexamined.

1. A method of cutting a fiber-cement workpiece, comprising:

pressing a first guide surface of a first guide member and a second guide surface of a second guide member against a surface of the workpiece, the first guide member having a first interior surface and the second guide member having a second interior surface spaced apart from the first interior surface by a gap, *and the first and second guide surfaces being in a common plane and configured to rest flat on top of the fiber-cement workpiece*;

reciprocating a cutting blade between the first and second guide members and along a path transverse to the surface of the workpiece, *the cutting blade having a top surface with a concave curvature with respect to the first and second guide surfaces, and* the cutting blade having a first side spaced apart from the first interior surface by a first side spacing and the cutting blade having a second side spaced apart from the second interior surface by a second side spacing, wherein the first side spacing and the second side spacing are approximately [0.040] *0.0425* to [0.055] *0.045* inch; and moving the cutting blade along a cutting path through the fiber-cement workpiece.

2. A method of cutting a fiber-cement workpiece *having a thickness of 0.25 inch*, comprising:

pressing a first guide surface of a first guide member and a second guide surface of a second guide member against a surface of the workpiece, the first guide member having a first interior surface and the second guide member having a second interior surface spaced apart from the first interior surface by a gap, *and the first and second guide surfaces being in a common plane and configured to rest flat on top of the fiber-cement workpiece*;

reciprocating a cutting blade between the first and second guide members and along a path transverse to the surface of the workpiece, *the cutting blade having a top surface with a concave curvature with respect to the first and second guide surfaces, and* the cutting blade having a first side spaced apart from the first interior surface by a first side spacing and the cutting blade having a second side spaced apart from the second interior surface by a second side spacing, wherein the first side spacing and the second side spacing are approximately [13%] *17%* to [22%] *18%* of a thickness of the fiber-cement workpiece; and moving the cutting blade along a cutting path through the fiber-cement workpiece.

7. A fiber-cement cutting tool, comprising:

a hand-held drive unit comprising a housing, a motor coupled to the housing, a switch operatively coupled to the motor to selectively activate the motor, and a drive assembly operatively coupled to the motor;

a guide assembly comprising first and second guide members attached to the drive unit, the first guide member having a first guide surface and a first interior surface, and the second guide member having a second guide surface and a second interior surface, wherein the first and second guide surfaces [define] *are configured to rest flat on top of the fiber-cement workpiece and to be in* a guide plane, and wherein the first interior surface is juxtaposed to the second interior surface across a gap; and a cutting blade between the first and second guide members and coupled to the drive assembly to reciprocate between the first and second guide members along a path transverse to the guide plane, the cutting blade having *a top surface with a concave curvature with respect to the first and second guide surfaces,* a first side spaced apart from the first interior surface of the first guide member by a first side spacing [and the cutting blade having] a second side spaced apart from the second interior surface of the second guide member by a second side spacing, wherein the first side spacing and the second side spacing are from [0.040] *0.0425 inch* to [0.055] *0.045 inch* to inhibit premature wear of the motor or the drive assembly and to provide even edge cuts along a fiber-cement workpiece cut by the cutting blade.

* * * * *